United States Patent [19]

Suzuki et al.

[11] 4,043,519

[45] Aug. 23, 1977

[54] HOLDER FOR ROLL OF STRIPPED MATERIAL

[76] Inventors: Teiji Suzuki, 6-2, Hon-cho 4-chome; Zenichiro Mizuno, 5-11, Sakura-Josui 3-chome, both of Tokyo, Japan

[21] Appl. No.: 665,542

[22] Filed: Mar. 10, 1976

[30] Foreign Application Priority Data

Nov. 5, 1975 Japan ..... 50-149934[U]

[51] Int. Cl.[2] ..... B65H 19/02

[52] U.S. Cl. ..... 242/55.53; 312/39

[58] Field of Search ..... 312/38, 39, 236; 242/55.2, 55.3, 55.53

[56] References Cited

U.S. PATENT DOCUMENTS

| | | | |
|---|---|---|---|
| 2,555,885 | 6/1951 | Hope | 242/55.53 |
| 2,643,069 | 6/1953 | Carlin | 242/55.53 |
| 3,428,267 | 2/1969 | Briles | 242/55.53 |
| 3,531,169 | 9/1970 | Hoffmann et al. | 312/236 |

*Primary Examiner*—Casmir A. Nunberg
*Attorney, Agent, or Firm*—Kurt Kelman

[57] ABSTRACT

Disclosed is a holder for a roll of sheet material, having a pair of support levers rotatable only in one vertical plane pivotally attached in the forward portions of lateral walls projecting from the opposed ends of a rear wall and normally protruding inwardly toward each other. When said roll of sheet material is pushed upwardly in the holder from below said pair of support levers, said pair of support levers are brought into contact with the corners of the roll and are consequently rotated divergently. They presently ride over the corners of the roll and begin to slide over the lateral sides of the roll. When the forward tips of the support levers reach the open ends of the tubular core at the center of the roll, said pair of support levers return to their horizontal position, with the result that the roll will be set stably in position in the holder.

2 Claims, 4 Drawing Figures

HOLDER FOR ROLL OF STRIPPED MATERIAL

BACKGROUND OF THE INVENTION

This invention relates to a holder for use with a roll of sheet material such as of toilet paper, paper toweling, synthetic resin film, etc. (hereinafter referred to as "roll of sheet material").

It has heretofore been customary for the roll of sheet material to be held in position by being accommodated within a container provided with a slit for dispensatory discharge of the material or by inserting a roller through the tubular core of said roll and causing this roller to be supported at the opposed ends thereof on a holder.

The holder of the former principle entails a disadvantage that the sheet material, while being discharged through said slit, tends to sustain rupture prior to departure from the container interior or the holder itself has a complicated structure. The holder of the latter principle has a disadvantage that the user is compelled to go through the troublesome operation of removing the roller from the holder while keeping the roller in a contracted state by exertion of force thereon, inserting the removed roller through the tubular core of a newly supplied roll of sheet material and subsequently causing the roller, in conjunction with the roll carried thereon, to snap into position on the holder while keeping the roller again in a contracted state by exertion of force thereon.

As described above, the conventional holders for rolls of sheet materials have possessed a complicated structure or have inevitably necessitated troublesome operations in exchanging the remnant of a consumed roll with a newly supplied roll.

An object of the present invention is to provide a holder for a roll of sheet material, which holder has a simple structure and permits the setting of the roll in position to be accomplished by a simple movement of one hand of the user.

The expression "roll of sheet material" as used in the specification hereof refers to a strip of toilet paper, paper toweling, synthetic resin film, aluminum foil or the like which is wrapped round and round in the form of a roll containing at the center thereof a hole for insertion of a roller. Such a roll is generally wrapped round the outside of a tubular core.

SUMMARY OF THE INVENTION

To accomplish the object described above according to the present invention, there is provided a holder for a roll of sheet material, which roll holder comprises a framework consisting of a rear wall and a pair of lateral walls projecting from the opposed ends of said rear wall and thereby enclosing therein a space for accommodating said roll, and a pair of support levers pivotally attached to the forward portion of each of said lateral walls, said support levers being disposed in such a way that the leading tips of said support levers usually point inwardly toward each other inside the framework and the support levers themselves are allowed to rotate in only one vertical plane.

As the roll of sheet material is moved upwardly inside the holder from below the support levers, the pair of support levers projecting from the opposed lateral walls are brought into contact with the upper ends of the corresponding circular edges of the roll and are gradually rotated upwardly in their respectively vertical planes until they ride over the edges and begin to slide on the lateral sides of the roll. As the roll has been moved to the point at which the support levers enter the open ends of the tubular core contained at the center of the roll, they are allowed to return to their original horizontal positions to hold the roll in position. As the roll is further moved upwardly from this position, the support levers are again rotated gradually and then caused to slide on the lateral sides of the roll in exactly the same way as described above until the roll is completely removed from the holder.

The roll holder of the present invention, as described above, enables the roll to be set in position or removed by simply causing the roll to be moved upwardly within the holder interior. This work is accomplished readily by the movement of one hand of the user. The structure of this holder is simple because it dispenses with said contractible roller and only requires a pair of support levers to be pivotally attached to the opposed lateral walls.

The other objects and characteristic features of the present invention will become apparent from the description to be given in further detail herein below with reference to the accompanying drawing.

DETAILED DESCRIPTION OF THE INVENTION

Figure 1:
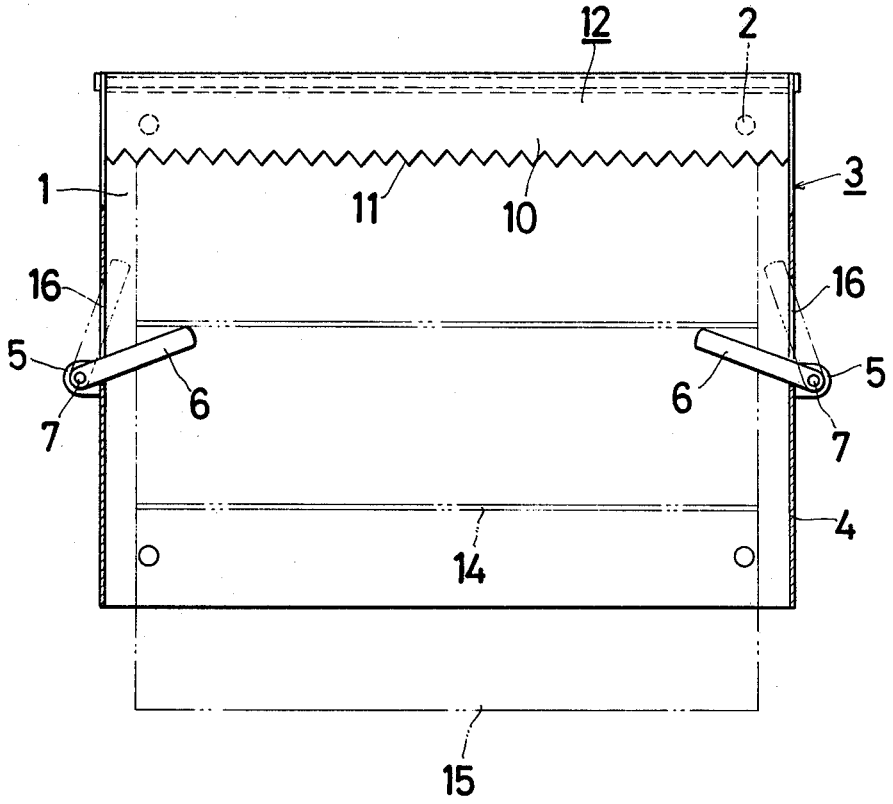
FIG. 1 is a front view illustrating one preferred embodiment of the holder for a roll of sheet material according to the present invention.
Figure 2:
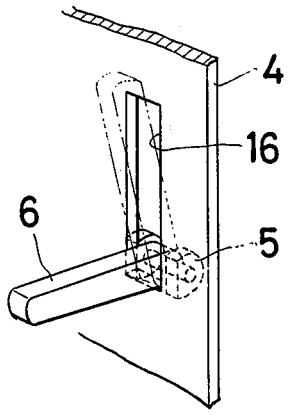
FIG. 2 is an enlarged perspective view of the essential part of the holder of FIG. 1.

FIGS. 1 and 2 illustrate the first preferred embodiment of the holder for a roll of sheet material according to the present invention. A framework 3 comprises a rear wall 1 containing perforations 2 utilized for attaching the holder to the wall, such as of a toilet or kitchen, and lateral walls 4 projecting from the opposed ends of rear wall 1. In the forward portion of the inside wall of each of opposed lateral walls 4, there is disposed a bracket 5. One end of a support lever 6 is pivotally attached by pivot pin 7 to bracket 5 and the lateral walls define slits 16 immediately above brackets 5. The support levers are given a length slightly smaller than the inside diameter of the tubular core at the center of the roll of stripped material. The distance between the forward tips of the pair of support levers 6 projecting in inwardly inclined directions from the inner surfaces of the lateral walls 4 is slightly smaller than the width of the roll 15 of stripped material to be held by the holder and the distance between the brackets 5 disposed on the inner surfaces of the lateral walls 4 is slightly larger than said width of the roll.

To the upper posterior portions of the lateral walls 4, the opposed extremities of the rear edge of a cover 12 having the forward portion arched downwardly are pivotally attached. A cutting edge 11 may be formed at the forward end of the cover 12. The length to which the support levers 6 are allowed to protrude from the inner surfaces of the walls is smaller than the inside diameter of the tubular core 14 at the center of the roll of sheet material. The distance between the forward tips of the support levers which are in a state protruding from the inner surfaces of the lateral walls is smaller than the width of the roll of stripped material to be held. The slits 16 are given a height such that their upper ends prevent the support levers from rotating past the slits and moving beyond the walls. The lower ends of said slits are positioned so that the support levers, when allowed to protrude inwardly, will be prevented from rotating past the horizontal level. Owing to the slits of such specific dimensions, the support levers on the opposed lateral walls are held aslant towards the inner surfaces of the walls. Because the lower ends of the support levers are kept in contact with the lower ends of the slits, the levers are prevented from rotating past the horizontal level.

For the roll of sheet material to be set in position in the holder of the configuration described above, one is only required to move the roll upwardly inside the holder from below the support levers 6. As the roll moves upwardly, the support levers which protrude from the opposed lateral walls are pushed up by the corners of the roll and consequently are turned in the vertical direction. The support levers presently ride over the corners of the roll and begin to slide over the lateral sides of the roll. As the forward tips of the support levers reach the open ends of the tubular core at the center of the roll, the support levers fall into their horizontal positions by virtue of their own weight, with the result that the roll of stripped material will be held stably in position in the holder. After the entire roll of stripped material has been used up, removal of the remnant of the roll is readily accomplished by moving the remnant upwardly so that the support levers are pushed up divergently to permit release of the tubular core.

Figure 3:
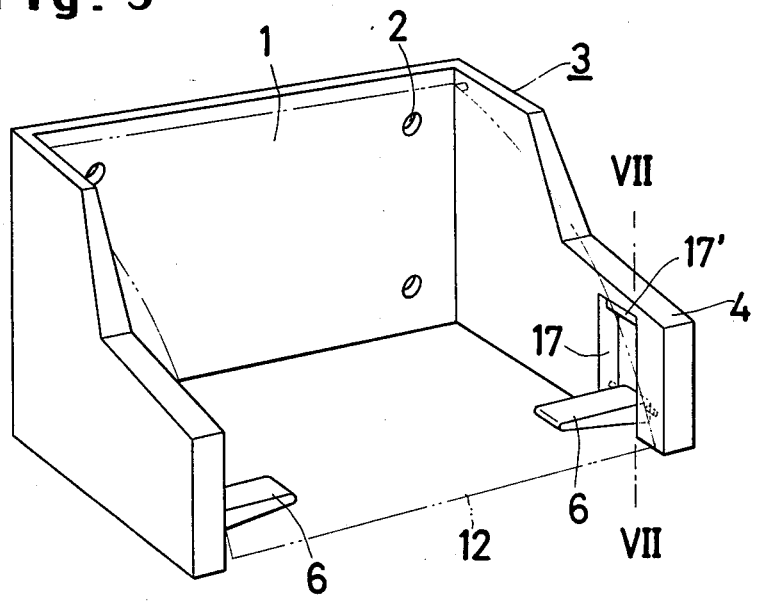
FIG. 3 is a front view illustrating another preferred embodiment of the holder for a roll of sheet material according to the present invention.
Figure 4:
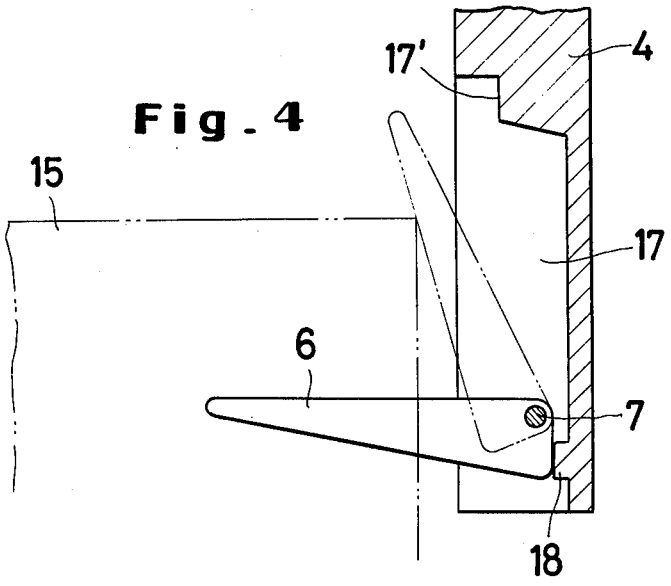
FIG. 4 is a sectional view taken along the line VII—VII of FIG. 3.

FIGS. 3 and 4 illustrate another embodiment of the holder for a roll of sheet material according to the present invention. The opposed lateral walls 4 which are components of the framework have an increased wall thickness. In the forward portions of lateral walls 4, grooves 17 are formed one in the inner wall of each of said lateral walls. To the lower portions of grooves 17, the lower ends of support levers 6 are pivotally attached by pivot pins 7. Protuberances 18 are disposed below the pivot point of each of the support levers in the grooves 17. These protuberances are of a size such that the lower sides of said support levers collide with the protuberances and consequently are prevented from rotating past the horizontal level. In the upper portions of the grooves 17, shoulders 17' are disposed so that when the support levers tend to rotate past the vertical lines, they collide with shoulders 17' and are consequently prevented from rotating beyond said vertical lines. Usually, therefore, the support levers which project from the opposed lateral walls are maintained by virtue of their own weight in their horizontal position.

The distance between the opposed lateral walls 4 is slightly greater than the width of the roll of sheet material and the length to which the support levers project out of the inner surfaces of the walls is smaller than the inside diameter of the tubular core at the center of the roll.

For the roll of sheet material to be set in position in the holder of the aforementioned configuration, one has only to move the roll upwardly inside the holder from below the support levers. The corners of the roll of stripped material push the support levers and cause them to rotate divergently. The support levers then ride over said corners of the roll and begin to slide over the lateral sides of the roll. When the forward tips of the support levers reach the open ends of the tubular core at the center of roll, the support levers fall by virtue of their own weight into their horizontal position, with the result that the roll of paper will be set stably in position in the holder. After the entire roll of sheet material has been used up, removal of the remnant of the roll can easily be accomplished by moving the remnant upwardly so that the support levers are pushed out to be received inside the grooves 17, permitting release of the tubular core.

As is clear from the foregoing description, the holder for the roll of stripped material according to the present invention has a very simple structure, because all that is required is to dispose on the opposed lateral walls the support levers which are usually held inwardly toward each other and are permitted to rotate only in one vertical plane. Thus, it may easily be fabricated from metallic materials, plastic materials, wood, etc. Unlike the conventional roll holders using a contractible roller, the holder of the present invention dispenses with the manipulation for the removal of the roller. It permits the roll of sheet material to be set in position when the roll is pushed upwardly in the holder from below. After the entire roll has been used up, the tubular core of the roll can quickly be replaced with a newly supplied roll by the movement of one hand of the user, because the tubular core is simultaneously pushed out of the holder when the new roll is pushed up into position in the holder. Once the roll is set stably in position inside the holder, there is no possibility of the roll being moved out of position by a force exerted thereon in a lateral or downward direction. The holder, therefore, can advantageously be utilized for holding a sheet material such as toilet paper, paper toweling or synthetic resin film which is wrapped round and round in the form of a roll.

What is claimed is:

1. A holder for a roll of sheet material having a cylindrical center hole of a predetermined diameter, the holder comprising a. a framework consisting of a rear wall and a pair of lateral side walls projecting from opposed ends of the rear wall, the walls of the framework enclosing a space for accommodating the roll;

b. a pair of support levers for the roll, each of the support levers being pivotally mounted in a respective one of the side walls for free pivoting movement in a common plane extending perpendicularly to the side walls, each support lever having a tail end and a forward end, the forward ends projecting towards each other into said space, and the side walls being formed with respective grooves, each groove defining an upper shoulder engaging the forward end of an associated support lever when the support levers are pivoted upwardly in the common plane into a retracted position, said grooves having respective lower portions, said tail ends being pivoted to said side walls in said lower portions respectively, the length of the support levers being in excess of that of the grooves whereby only a portion of the support levers is received in the grooves in the retracted position and being shorter than the diameter of the center hole whereby the support levers are freely pivoted from the retracted position into a support position within the center hole when the center hole is in alignment with the support levers; and c. a cover for the roll, the lateral side walls having upper posterior portions and the cover having a rear edge pivotally attached to the posterior portions of the lateral side walls.

2. The holder of a roll of sheet material as set forth in claim 1, further comprising a stop in the lower portion of the grooves for maintaining the support levers in the support position.

* * * * *